US012404772B2

(12) United States Patent
Zhu et al.

(10) Patent No.: US 12,404,772 B2
(45) Date of Patent: Sep. 2, 2025

(54) ZONAL BOLT-GROUTING SUPPORT DEVICE AND METHOD FOR CATACLASTIC ROCK MASS LARGE DEFORMATION OF HIGH-STRESS TUNNEL

(71) Applicants: POWERCHINA Kunming Engineering Corporation Limited, Yunnan (CN); Huaneng Lancang River Hydropower Inc, Yunnan (CN); Institute of Rock and Soil Mechanics, Chinese Academy of Sciences, Hubei (CN)

(72) Inventors: Guojin Zhu, Yunnan (CN); Pengzhi Pan, Yunnan (CN); Xuexing Cao, Yunnan (CN); Yangyi Zhou, Yunnan (CN); Zhaofeng Wang, Yunnan (CN); Shijie Yang, Yunnan (CN); Xufeng Liu, Yunnan (CN); Huyue Zhan, Yunnan (CN); Fengqiong Li, Yunnan (CN)

(73) Assignees: POWERCHINA Kunming Engineering Corporation Limited, Kunming (CN); Huaneng Lancang River Hydropower Inc, Kunming (CN); Institute of Rock and Soil Mechanics, Chinese Academy of Sciences, Wuhan (CN)

( * ) Notice: Subject to any disclaimer, the term of this patent is extended or adjusted under 35 U.S.C. 154(b) by 70 days.

(21) Appl. No.: 18/497,882

(22) Filed: Oct. 30, 2023

(65) Prior Publication Data

US 2024/0141785 A1 May 2, 2024

Related U.S. Application Data

(63) Continuation of application No. PCT/CN2023/123484, filed on Oct. 9, 2023.

(30) Foreign Application Priority Data

Oct. 29, 2022 (CN) ..... 202211339372.8

(51) Int. Cl.
*E21D 20/02* (2006.01)

(52) U.S. Cl.
CPC ..... *E21D 20/021* (2013.01); *E21D 20/028* (2013.01)

(58) Field of Classification Search
CPC ..... E21D 20/02; E21D 20/021; E21D 20/025; E21D 20/028
(Continued)

(56) References Cited

U.S. PATENT DOCUMENTS 3,222,873 A * 12/1965 Williams ..... E02D 5/808 52/698
3,326,004 A * 6/1967 Williams ..... E21D 20/021 405/266
(Continued)

FOREIGN PATENT DOCUMENTS

CN 111271105 A * 6/2020
CN 112392524 A * 2/2021 ..... E02D 3/12
(Continued)

*Primary Examiner* — Frederick L Lagman

(57) ABSTRACT

A zonal bolt-grouting support device and method for cataclastic rock mass large deformation of a high-stress tunnel, the method includes: drill holes in surrounding rock of a tunnel against a tunnel face after rock mass excavation, install high-strength prestressed anchor members, apply a preload to anchor bolts when expansion anchoring agent is fully expanded and has a certain strength, and zonally grout the surrounding rock after stress adjustment. The high-strength prestressed anchor member comprises an anchor bolt, an expansion anchor agent, a decoupling material, a grouting device, a reverse anti-skid device, etc. The grouting device consists of a shallow grouting steel pipe, a deep
(Continued)

grouting steel pipe and a grouting stop valve, and the grouting steel pipe is arranged side by side with the anchor bolt in a drill hole. The technical proposal of the invention effectively inhibits the large deformation of a cataclastic rock mass.

6 Claims, 1 Drawing Sheet

(58) Field of Classification Search
USPC ..... 405/259.5
See application file for complete search history.

(56) References Cited

U.S. PATENT DOCUMENTS 3,379,019 A * 4/1968 Williams ..... E21D 20/021 52/704
3,695,045 A * 10/1972 Williams ..... F16B 13/14 52/698
3,994,138 A * 11/1976 Herbst ..... E02D 5/74 405/259.5
4,247,223 A * 1/1981 Amakasu ..... E21D 20/02 405/259.1
4,362,440 A * 12/1982 Glaesmann ..... E21B 33/129 405/269
4,413,929 A * 11/1983 Kigawa ..... E21D 21/0093 405/259.5
4,664,555 A * 5/1987 Herbst ..... E21D 21/006 405/259.1
4,750,887 A * 6/1988 Simmons ..... E21D 21/0086 405/259.5
4,832,534 A * 5/1989 Duvieusart ..... E21D 21/0026 405/259.5
4,938,631 A * 7/1990 Maechtle ..... E04G 23/0222 52/704
5,181,800 A * 1/1993 Stankus ..... E21D 21/0093 405/259.5
5,653,557 A * 8/1997 Gruber ..... E21D 20/02 405/269
7,318,689 B2 * 1/2008 Kanflod ..... E21B 17/0426 405/259.5
8,678,729 B2 * 3/2014 Salgado ..... F16B 13/141 405/259.5
8,721,227 B2 * 5/2014 Oldsen ..... E21D 21/0033 405/259.4
2012/0177448 A1 * 7/2012 Steyn ..... E21D 20/028 405/259.5
2015/0322785 A1 * 11/2015 Ahola ..... E21D 21/0033 405/259.5
2016/0177718 A1 * 6/2016 Cawood ..... E21D 21/004 405/259.5

FOREIGN PATENT DOCUMENTS

CN 112483149 A * 3/2021 ..... E21B 33/13
CN 115559762 A * 1/2023 ..... E21D 11/10

* cited by examiner

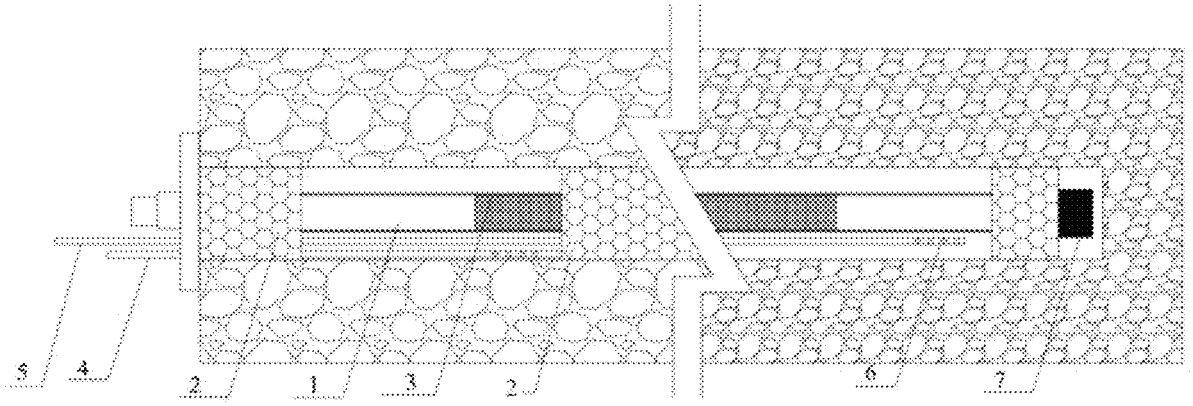
5
4
2
1
3
2
6
7

ZONAL BOLT-GROUTING SUPPORT DEVICE AND METHOD FOR CATACLASTIC ROCK MASS LARGE DEFORMATION OF HIGH-STRESS TUNNEL

CROSS-REFERENCE TO RELATED APPLICATIONS

This application is a continuation of PCT/CN2023/123484, filed Oct. 9, 2023 and claims priority of Chinese Patent Application No. 202211339372.8, filed on Oct. 29, 2022, the entire contents of which are incorporated herein by reference.

TECHNICAL FIELD

The invention relates to the technical field of geotechnical engineering, in particular to a zonal bolt-grouting support device and method for cataclastic rock mass large deformation of a high-stress tunnel.

BACKGROUND ART

The cataclastic rock mass is a typical complex geological mass, most of which is developed in the rock mass in the strong tectonic area. The self-stabilizing capacity of the rock mass is poor due to its broken structure, and large deformation easily occurs after excavation. With the gradual march of China underground engineering to the deep earth, the surrounding rocks for the deep cataclastic rock mass engineering will be broken within a wide range in a short time due to the high geostress stress level after tunnel excavation, forming a m-class large deformation disaster, seriously damaging the support structure, threatening the safety of construction personnel, causing large economic losses, and affecting the project progress.

As an efficient support method, the anchor bolt support has been widely used in the field of surrounding rock support. However, the anchor bolt support usually fails in the surrounding rock control practice of the cataclastic rock mass due to the broken surrounding rock and the lack of anchoring foundation. The effect of the grouting reinforcement method depends on the selection of grouting materials. However, the selection of grouting materials is mostly blind in the grouting practice, and the difference in the nature of surrounding rock is not fully considered, which greatly reduces the grouting effect. Therefore, there is no effective control method or means for large deformation control of cataclastic rock masses, especially deep cataclastic rock masses.

CONTENT OF INVENTION

To solve the technical problem of anchor bolt support failure due to the broken and the lack of anchoring foundation in the large deformation control of the cataclastic rock mass, the invention proposes a zonal bolt-grouting support method for the cataclastic rock mass large deformation of a high-stress tunnel.

To solve the above technical problems, the invention provides a zonal bolt-grouting support device and method for cataclastic rock mass large deformation of a high-stress tunnel.

The zonal bolt-grouting support device for the cataclastic rock mass large deformation of the high-stress tunnel comprises a high-strength prestressed anchor bolt, an expansion anchoring agent, a decoupling material, a grouting steel pipe and a reverse anti-skid device; the expansion anchoring agent is placed in the head, middle and tail of the anchor bolt respectively; the decoupling material is wound in the middle of the anchor bolt; the grouting steel pipe is arranged side by side with the anchor bolt in a drill hole.

The grouting steel pipe comprises a shallow grouting steel pipe and a deep grouting steel pipe; a grouting stop valve is installed at the end of the grouting steel pipe, and 3 to 5 grouting holes are drilled in the middle and tail of the grouting steel pipe;

The reverse anti-skid device is arranged at the tail of the anchor bolt and is a reverse anti-slip nut.

The expansion anchoring agent adopts a hollow structure and is inserted in the anchor bolt, the expansion rate of the expansion anchoring agent at the tail is higher than that of the expansion anchoring agent in the head and middle, and the expansion anchoring agent in the middle is located outside a broken rock zone of the surrounding rock.

The zonal bolt-grouting support method for the cataclastic rock mass large deformation of the high-stress tunnel includes the following steps:

Step 1: Drill holes in the surrounding rock of the tunnel against the tunnel face after rock mass excavation;

Step 2: Install the zonal bolt-grouting support device for the cataclastic rock mass large deformation of the high-stress tunnel;

Step 3: Apply a preload to the anchor bolts when the expansion anchoring agent at the tail of the anchor bolts has a certain strength;

Step 4: Inject quick setting cement grouting materials into the shallow surrounding rock after the stress adjustment;

Step 5: Inject slow setting cement grouting materials into the deep surrounding rock after the grouting pressure of the shallow surrounding rock reaches the set pressure.

The setting time of the quick setting cement grouting material is not more than 10 minutes, and the slow setting cement grouting material still has good fluidity after 30 minutes.

Compared with the prior art, the invention has the following advantages and beneficial effects:

(1) The expansion anchoring agent is used, and the volume thereof can be expanded in a short time, thereby extruding the cataclastic rock mass and forming a solid anchoring foundation.

(2) The prestress can be applied in a short time after the installation of the anchor bolt to quickly play a role of anchoring, enhance the timeliness of the anchor bolt support and reduce the deterioration of the rock mass caused by the strong unloading of the rock mass excavation at the high geostress.

(3) The performance requirements for the grouting materials vary with the degree of breaking of surrounding rock at different depths. The zonal grouting can be achieved by using the deep and shallow grouting steel pipes and the expansion agent, the quick setting material is used to fill and block the open cracks in the shallow surrounding rocks with a large degree of breaking to form a wall for grouting for deep high-pressure grouting, and the slow setting material is used in the deep surrounding rocks and has good fluidity and permeability to meet the needs of reinforcing small cracks in deep layers.

(4) The decoupling material is added to prevent the anchor bolt from being broken when the surrounding rock has a large deformation and further enhance the capability of the anchor bolt to adapt to the deformation of the surrounding rock.

DESCRIPTION OF DRAWINGS

FIG. 1 is the structure diagram of the zonal bolt-grouting support device for the cataclastic rock mass large deformation of the high-stress tunnel.

EMBODIMENTS

The embodiments of the invention are described in detail below, but are not used to limit the scope of the invention.

A zonal bolt-grouting support device for cataclastic rock mass large deformation of a high-stress tunnel comprises a high-strength prestressed anchor bolt 1, an expansion anchoring agent 2, a decoupling material 3, a grouting steel pipe and a reverse anti-skid device 7; the expansion anchoring agent 2 is placed in the head, middle and tail of the anchor bolt 1 respectively; the expansion anchoring agent 2 adopts a hollow structure and is inserted in the anchor bolt 1, the expansion rate of the expansion anchoring agent at the tail is higher than that of the expansion anchoring agent in the head and middle, and the expansion anchoring agent in the middle is located outside a broken rock zone of the surrounding rock. The decoupling material 3 is wound in the middle of the anchor bolt 1; the grouting steel pipe is arranged side by side with the anchor bolt 1 in a drill hole.

The grouting steel pipe comprises a shallow grouting steel pipe 4 and a deep grouting steel pipe 5; a grouting stop valve is installed at the end of the grouting steel pipe, and 3 to 5 grouting holes 6 are drilled in the middle and tail of the grouting steel pipe;

The reverse anti-skid device 7 is arranged at the tail of the anchor bolt 1 and is a reverse anti-slip nut.

A zonal bolt-grouting support method for cataclastic rock mass large deformation of a high-stress tunnel includes the following steps:

Step 1 Drill holes vertically in the rock wall after the tunnel is excavated.

Step 2 Install the reverse anti-skid device 7 at the end of the anchor bolt 1, and install the expansion anchoring agent 2 and the decoupling material 3.

Step 3 Connect the grouting device composed of the shallow grouting steel pipe 4, the deep grouting steel pipe 5 and the grouting stop valve, and drill jet holes 6 in the middle and tail of the grouting pipe.

Step 4 Place the anchor bolt 1 and the grouting device in the drill hole.

Step 5 Install a tray, an aligning ball seat and a nut after the expansion agent at the end of the anchor bolt 1 expands.

Step 6 Apply a preload to the anchor bolt 1.

Step 7 Inject the quick setting cement grouting material into the shallow surrounding rock through the shallow grouting steel pipe 4 after the stress adjustment.

Step 8 Inject the slow setting cement grouting material into the deep surrounding rock through the deep grouting steel pipe 5 when the grouting pressure of the shallow surrounding rock reaches 1 MPa.

For the expansion agent ratio, refer to Patent No. 201810939916.1.

For the decoupling material, refer to Patent No. 201810283159.7.

For the grouting material ratio, refer to Patent No. 201310566695.5.

The above is one embodiment of the invention, but does not limit the scope of protection of the invention. Equivalent structure transformations by using the specification or drawings of the invention or application to other technical fields should fall within the scope of protection of the invention.

The invention claimed is:

1. A zonal bolt-grouting support device for cataclastic rock mass large deformation of a high-stress tunnel, comprising:

a high-strength prestressed anchor bolt (1);

an expansion anchoring agent (2);

a decoupling element (3);

a grouting steel pipe; and a reverse anti-skid device (7);

wherein the expansion anchoring agent (2) is placed in a head, a middle, and a tail of the anchor bolt (1) respectively; the decoupling element (3) is continuously wound in the middle of the anchor bolt (1) and passes through the expansion anchoring agent (2) at the middle of the anchor bolt (1), to prevent the anchor bolt from being broken when a surrounding rock has a large deformation; the grouting steel pipe is arranged side by side with the anchor bolt (1) in a drill hole;

the grouting steel pipe comprises a shallow grouting steel pipe (4) and a deep grouting steel pipe (5), both of which insert the expansion anchoring agent (2); a grouting stop valve is installed at an end of the grouting steel pipe, and 3 to 5 grouting holes (6) are drilled in a middle and a tail of the grouting steel pipe; and the reverse anti-skid device (7) is arranged at the tail of the anchor bolt (1).

2. The zonal bolt-grouting support device for the cataclastic rock mass large deformation of the high-stress tunnel according to claim 1, wherein the reverse anti-skid device (7) is a reverse anti-slip nut.

3. The zonal bolt-grouting support device for the cataclastic rock mass large deformation of the high-stress tunnel according to claim 1, wherein the expansion anchoring agent (2) adopts a hollow structure and is inserted in the anchor bolt (1), an expansion rate of the expansion anchoring agent at the tail is higher than that of the expansion anchoring agent in the head and the middle, and the expansion anchoring agent in the middle is located outside a broken rock zone of the surrounding rock.

4. A zonal bolt-grouting support method for cataclastic rock mass large deformation of a high-stress tunnel, comprising the following steps:

step 1: drilling holes in a surrounding rock of the tunnel against a tunnel face after rock mass excavation;

step 2: installing the zonal bolt-grouting support device for the cataclastic rock mass large deformation of the high-stress tunnel in claim 3;

step 3: applying a preload to the anchor bolt (1) when the expansion anchoring agent (2) at the head and tail of the anchor bolt (1) has a certain strength;

step 4: injecting quick setting cement grouting materials into a shallow surrounding rock through the shallow grouting steel pipe (4) after stress adjustment;

step 5: injecting slow setting cement grouting materials into a deep surrounding rock through the deep grouting steel pipe (5) after a grouting pressure of the shallow surrounding rock reaches a set pressure.

5. A zonal bolt-grouting support method for cataclastic rock mass large deformation of a high-stress tunnel, comprising the following steps:

step 1: drilling holes in a surrounding rock of the tunnel against a tunnel face after rock mass excavation;

step 2: installing the zonal bolt-grouting support device for the cataclastic rock mass large deformation of the high-stress tunnel in claim 1;

step 3: applying a preload to the anchor bolt (1) when the expansion anchoring agent (2) at the head and tail of the anchor bolt (1) has a certain strength;

step 4: injecting quick setting cement grouting materials into a shallow surrounding rock through the shallow grouting steel pipe (4) after stress adjustment;

step 5: injecting slow setting cement grouting materials into a deep surrounding rock through the deep grouting steel pipe (5) after a grouting pressure of the shallow surrounding rock reaches a set pressure.

6. The zonal bolt-grouting support method for the cataclastic rock mass large deformation of the high-stress tunnel according to claim 5, wherein a setting time of the quick setting cement grouting materials is not more than 10 minutes, and the slow setting cement grouting materials still have good fluidity after 30 minutes.

* * * * *